United States Patent [19]

Korfmann et al.

[11] 4,365,382

[45] Dec. 28, 1982

[54] CHIMNEY CLEANING SYSTEM

[76] Inventors: Robert G. Korfmann, R.D. #1, Box 222A; Richard C. Bennett, R.D. #1, Box 172, both of Wyalusing, Pa. 18853

[21] Appl. No.: 226,410

[22] Filed: Jan. 19, 1981

[51] Int. Cl.[3] ..... F23J 3/00

[52] U.S. Cl. ..... 15/249; 15/243

[58] Field of Search ..... 15/162, 163, 242, 243, 15/249, 104.3 R; D4/1; 98/66 R, 83; 134/1

[56] References Cited

U.S. PATENT DOCUMENTS

| | | | |
|---|---|---|---|
| 1,030,733 | 6/1912 | Johnston | 15/163 |
| 1,104,030 | 7/1914 | Willat | 15/243 X |
| 1,315,849 | 9/1919 | MacDonald | 15/243 |
| 4,090,271 | 5/1978 | Piontkowski et al. | 15/243 |
| 4,185,351 | 1/1980 | Radsavitch | 15/243 |
| 4,218,803 | 8/1980 | Clifford | 15/104.3 R |

FOREIGN PATENT DOCUMENTS

| | | | |
|---|---|---|---|
| 537235 | 10/1931 | Fed. Rep. of Germany | 15/163 |
| 82492 | 9/1953 | Norway | 15/163 |

*Primary Examiner*—Edward L. Roberts
*Attorney, Agent, or Firm*—George E. Clark

[57] ABSTRACT

A chimney cleaning system which can be operated from the ground and which does not require the user to climb a ladder to the top of the chimney includes a cleaning head constructed of a number of sections of iron or like material connected together by support members of length appropriate to the particular interior dimensions of the chimney to be cleaned and suspended by a chain or cable from a tubular support member which is adapted to align the cleaning head within the chimney or flue and to provide a guide for the cable to the ground for ready access by the user without the need for pulleys. An anti-down draft cap may be mounted at the end of the tubular support member immediately above the chimney opening to enhance the operation of the chimney system. The anti-down draft cap mounts to a support means on the end of the tubular support member. The tubular support member is mounted to the outside of the chimney by stainless steel bands or the like.

2 Claims, 6 Drawing Figures

CHIMNEY CLEANING SYSTEM

BACKGROUND OF THE INVENTION

The present invention relates to chimney cleaning apparatus and more particularly to chimney cleaning apparatus including a cleaning head of efficient design to more thoroughly clean chimneys and chimney flues.

Prior Art

In the prior art there are a number of chimney cleaning systems which may be operated from the ground by the user. However, the prior art systems all have one or more disadvantages relating to the efficiency of the cleaning, ease of operation or complexity of the mechanical apparatus. The following United States Patents illustrate the prior art.

U.S. Pat. No. 1,030,733 shows a chimney cleaner which employs a concrete block having a number of wire brush elements embedded within the sides of the concrete block for wiping the interior surfaces of a chimney or chimney flue, the concrete block having a weight element suspended below it and the block being supported by a cable through a tubular support member having a number of pulleys therein for supporting and moving the support cable. The patent further shows a drum and rachet arrangement to allow an operator at ground level to move the cleaning block up and down within the chimney flue.

The major disadvantage of the apparatus shown in this patent is that the cleaning head is in the form of a concrete block with wire brushes attached which effectively blocks the flue during use and does not allow exhaust gases to pass. Therefore, the cleaning head can not be left within the flue nor above the flue while the chimney is in use. The method of use as iindicated in the patent requires that a weighted ball or the like be attached to the cable through an opening in the lower part of the flue and then the weighted ball be cranked to the top of the tubular support member while the chimney is used to exhaust gases. The apparatus of this patent is very cumbersome and is rather inconvenient to use.

U.S. Pat. No. 1,054,924 shows a chimney cleaning brush which is spring mounted and is forced by the spring from the bottom of the chimney flue upwards and when it is pulled down the bristles of the sweeping body rub along the walls of the chimney and scrape off soot and other collected material. The cleaning apparatus according to the patent does not have a mechanism which is simple in construction and readily operated by a user from ground level. Also, the spring loaded brush mechanism is less efficient in cleaning than a rigid surfaced cleaning head.

U.S. Pat. No. 1,475,229 teaches a chimney cleaner which includes a tubular guide pipe and a pulley arrangement and further includes a wire brush head for cleaning a chimney or flue.

The apparatus of the patent is complex, awkward and does not provide as thorough cleaning of an interior surface of a chimney as does a rigid cleaning head.

U.S. Pat. No. 1,758,950 teaches a chimney cleaner having a plurality of spaced scrapers mounted on a spindle. The chimney cleaner of the patent must be completely removed from the chimney when not in use since the scrapers are of solid construction and would block the flow of exhaust gases up the chimney.

U.S. Pat. No. 1,770,436 shows a chimney sweeping apparatus employing a solid block for supporting a number of wire brushes or the like and having a soot collection pan mounted beneath the brush block. The apparatus of this patent like that of U.S. Pat. No. 1,030,733 must be completely removed from the chimney so that the chimney may be used to exhaust gases since the brush block is of a solid construction and would not permit the passage of exhaust gases.

U.S. Pat. No. 4,028,769 shows a chimney cleaning apparatus including a cleaning head which is lowered by a cable or rope from a pulley into the interior of a chimney to be cleaned. Weights are added to the cleaning head to enhance the cleaning action of the device.

The cleaning device according to the patent has many of the disadvantages as discussed previously with respect to U.S. Pat. No. 1,758,950.

U.S. Pat. No. 4,090,271 shows a chimney cleaner designed to be lowered through a chimney from its upper end including scrubing elements and chopping elements for removing soot, tar, mortar and the like from the interior walls of the chimney. The scrubing elements are adjustable to clean various sized chimney flues.

The structure cleaner according to the patent has scrubing elements only on two surfaces of the chimney cleaner which would require in a rectangular chimney additional passes with the chimney cleaner mounted at a ninety degree angle to a first pass or passes to completely clean the sides of the chimney.

U.S. Pat. No. 4,185,351 relates to a chimney cleaning apparatus having a catch assembly for enabling an operator standing at ground level to lock the cleaning device into fixed position within the flue and to quickly and safely remove the cleaning device from its locked position by action of the operator from the ground. The patent does not specifically teach a chimney cleaning system, but rather an accessory latch arrangement for a chimney cleaning system.

U.S. Pat. No. 4,208,756 relates to a chimney cleaning system which is permanently installed in a chimney and which is operated by a cord and pulley system from an interior base opening of the chimney. The patent also shows a soot collection bag mounted below the sand bag scraping means.

The apparatus of the patent must be operated from the inside of the chimney flue at the base thereof and is not readily operable or accessable by an operator from the outside of the chimney.

Each of the above identified prior art patents has one or more disadvantages in cleaning efficiency and in ease of operation.

SUMMARY OF THE INVENTION

Therefore, it is an object of the present invention to clean a chimney with a chimney cleaning system which includes a cleaning head constructed of a number of cleaning blades attached by support means in a configuration which matches the configuration of the flue or chimney to be cleaned and suspended by a cable or the like within a chimney or flue by a tubular support member which provides a conduit for the support cable to a ground location where the system may be easily operated by the user. The tubular member is adapted to mount an anti-draft cap at an end thereof to reduce down drafts in the chimney.

It is another object of the present invention to clean a chimney with a chimney cleaning system as above wherein each of the cleaning blades are formed in a manner so as to provide maximum cleaning efficiency as the cleaning head is raised and lowered within the chimney.

It is yet another object of the present invention to clean a chimney with a chimney system as above wherein the cleaning head may be left within the chimney flue while the chimney is being used to exhaust gases without impeding the flow of the exhaust gases.

Accordingly, a chimney cleaning system includes a cleaning head constructed of a number of cleaning blades, the cleaning blades having pointed ends on both top and bottom of each blade and the blades being attached by a support means in a configuration adapted to the configuration of the interior of a chimney or chimney flue, and wherein the cleaning head is suspended by a cable or the like within the chimney or flue by a support cable which passes through a tubular support member to the ground so that the chimney may be readily cleaned by the user from the ground in an efficient manner and wherein the chimney cleaning head is of a design and construction to permit the head to be left in the chimney while the chimney is in use to exhaust gases without impeding the flow of the exhaust gases. The tubular support member is adapted to mount an anti-draft cap at an end thereof to reduce down drafts in the chimney and to protect against rain and other precipitation from passing down the chimney.

These and other objects of the present invention will become immediately apparent from the following detailed description in conjunction with the accompanying drawing.

DETAILED DESCRIPTION OF A PREFERRED EMBODIMENT

Figure 1:
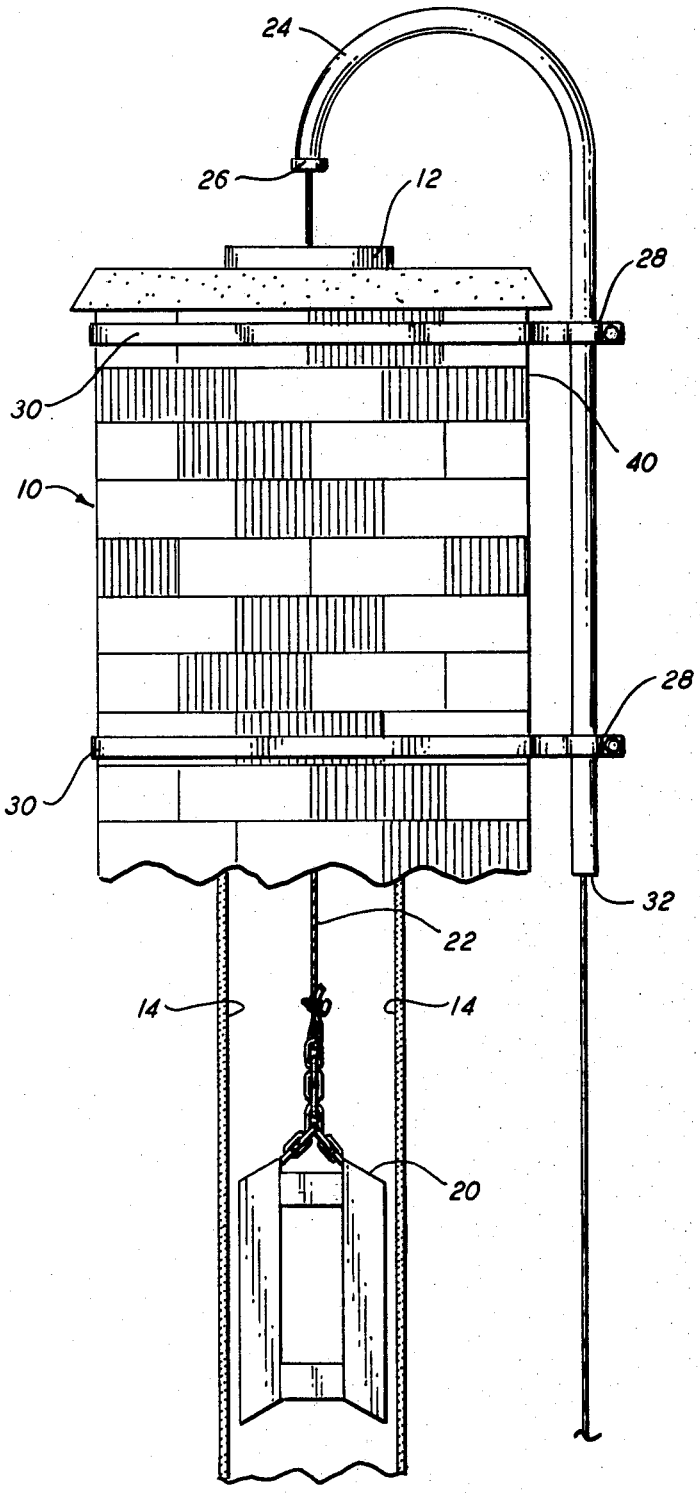
FIG. 1 is a side view of a cleaning system according to the present invention including a partial section view of the interior of the chimney or flue showing the cleaning head.

A chimney cleaning system which is designed to be left in a chimney and which is readily operated from ground level to provide an efficient cleaning of a chimney is shown in FIG. 1. Chimney 10 includes a centrally located flue 12 for the passage of exhaust gases from a heating system (not shown).

In many heating systems which use wood as a fuel, creosote and other combustion products tend to build up on the inner walls 14 of flue 12 and can in certain situations ignite causing chimney fires.

To eliminate the creosote and soot build up in chimney flues, it is customary to clean a chimney flue on a regular basis during the heating season. The prior art described above shows many systems for cleaning chimneys but all have a variety of disadvantages which are overcome by the present invention.

A cleaning head 20 is suspended by cable 22 from tubular support pipe 24 which has an opening 26 aligned with the central axis of flue 12.

Support pipe 24 is fastened to chimney 10 by clamps 28 and bands 30 which pass around the outer perimeter of chimney 10.

Cable 22 which may be a galvanized air craft cable or similar steel cable passes through tubular support pipe 24 exiting at the bottom end 32 thereof and extending to ground level where an operator would have easy access to the cable to pass cleaning head 20 up and down within flue 12 to clean the interior surfaces of flue 12.

Figure 2:
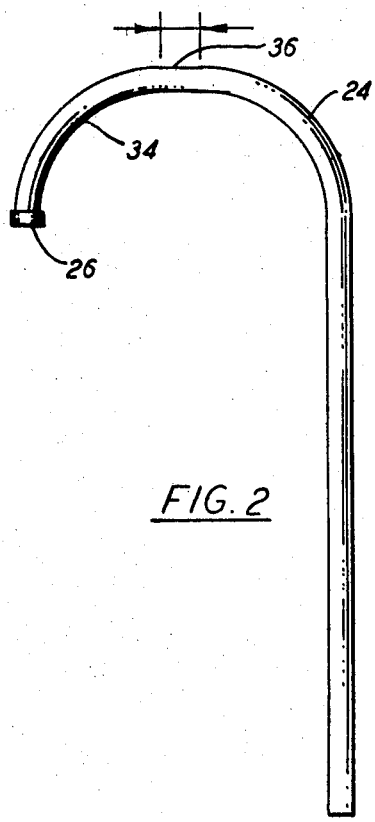
FIG. 2 is a side view of an alternate embodiment of a cable support member to be used with the present invention.

Referring now to FIG. 2, a second embodiment of tubular support pipe 24 is shown which has a straight portion 36 in curved portion 34 of pipe 24 to extend the opening 26 to the center of larger chimneys or chimneys where the flue 12 is displaced further from an edge 40 of chimney 10 than is shown with the embodiment of FIG. 1.

Figure 4:
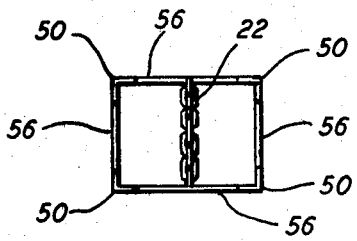
FIG. 4 is a top view of the cleaning head shown in FIG. 3.
Figure 3:
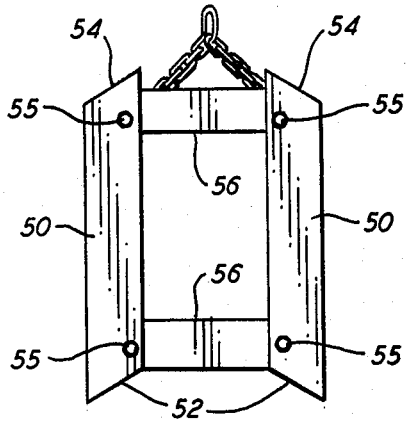
FIG. 3 is a side view of a cleaning head according to the present invention.

Referring now to FIGS. 3 and 4, the cleaning head of novel design according to the present invention will be described.

Cleaning head 20 includes in the embodiment shown in FIG. 1 four iron corner pieces 50 having pointed blade portions 52 at the lower end thereof and blade portions 54 at the upper end thereof. The iron pieces 50 are joined by support members 56 which may be flat iron stock and fastened by bolts 55. Cleaning head 20 in a most common embodiment, weighs about twenty pounds which is sufficient weight to loosen and remove accumulated creosote and other build up on the sides 14 of flue 12.

Since cleaning head 20 is in essence an open frame having blades at the corners thereof, flue exhaust gases can pass through it unimpeded, thus permitting the cleaning head to remain in the chimney flue 12 while the chimney is being used to exhaust gases.

Figure 5:
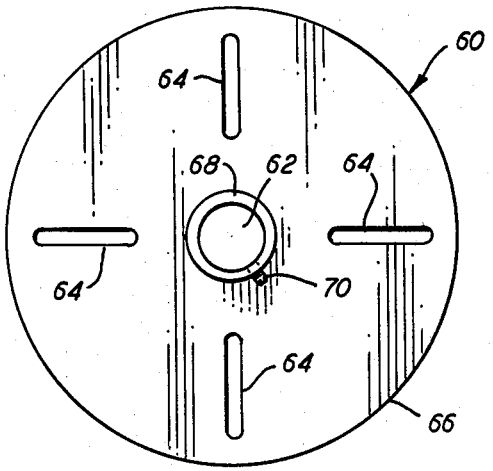
FIG. 5 is top view of anti-down draft cap to be used with the present invention.
Figure 6:
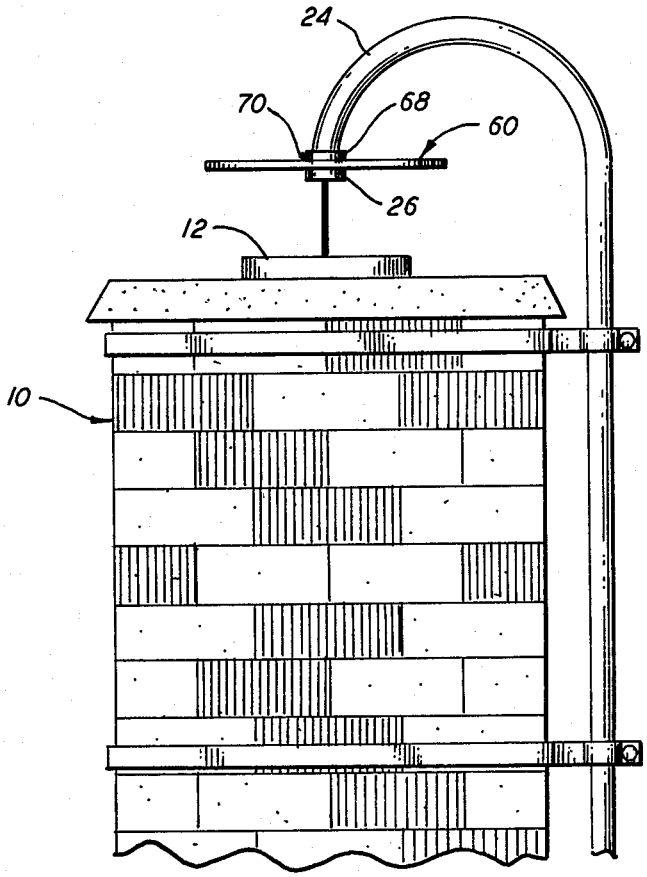
FIG. 6 is a side view of the tubular support member of the present invention with the anti-down draft cap shown in FIG. 5 in place.

Referring now to FIGS. 5 and 6, the anti-down draft cap will be discussed. A circular sheet metal element 60 having a centrally located hole 62 therein, the diameter of hole 62 being just large enough to pass around the outside of support pipe 24. The anti-down draft cap 60 further having slots 64 running radially from center hole 62 to the outer rim 66. The number of slots may be four or eight with no significant change in effectiveness. In use (see FIG. 6) anti-down draft cap 60 is slid over pipe 24 and is supported by end cap 26 at a predetermined elevation above the flue 12. The diameter of anti-down draft cap 60 must be large enough to completely cover flue 12 and protect against down drafts and against precipitation passing down the flue 12.

Anti-down draft cap 60 may also include a neck 68 having a set screw 70 which may be tightened against support pipe 24 to hold the anti-down draft cap 60 firmly in place.

Although a preferred embodiment of the invention has been described, it will be apparent to those skilled in the art that there are many variations and modifications which may be made without departing from the spirit or scope of the invention. Therefore, the invention is not to be limited by the specific disclosure of a preferred embodiment herein, but only by the appended claims.

What is claimed is:

1. A chimney cleaning system, comprising:

a cleaning head, constructed of a plurality of metal sections, each of said sections having a sharpened lower end for more efficiently removing soot and creosote from an inner surface of said chimney, said cleaning head being formed to adapt to the interior dimensions of a chimney to be cleaned;

a support system for said cleaning head, said support system comprising a cable attached to said cleaning head, said cable being supported by a tubular support member which is attached to an exterior of said chimney and which passes said cable to a user at ground level; and an anti-down draft cap affixed to said tubular support member and positioned at a predetermined distance above a top of said chimney for reducing down drafts into said chimney and for protecting said chimney from rain and other forms of precipitation, said anti-down draft cap further comprising a plurality of radially extended slots therein to allow free passage of wind and exhaust gases from said chimney.

2. A chimney cleaning system according to claim 1 wherein said anti-down draft cap further comprises a neck and a set screw for attachment to said tubular support member at a predetermined distance above said top of said chimney.

* * * * *